US011022149B2

(12) United States Patent
Berding et al.

(10) Patent No.: US 11,022,149 B2
(45) Date of Patent: Jun. 1, 2021

(54) SWITCHED SUCTION JET PUMP

(71) Applicant: POLYTEC PLASTICS GERMANY GMBH & CO. KG, Lohne (DE)

(72) Inventors: Christian Berding, Lohne (DE); Christoph Leson, Dinklage (DE)

(73) Assignee: Polytec Plastics Germany GMBH & CO. KG, Lohne (DE)

( * ) Notice: Subject to any disclaimer, the term of this patent is extended or adjusted under 35 U.S.C. 154(b) by 161 days.

(21) Appl. No.: 16/488,017

(22) PCT Filed: Mar. 7, 2018

(86) PCT No.: PCT/EP2018/055584

§ 371 (c)(1),
(2) Date: Aug. 22, 2019

(87) PCT Pub. No.: WO2018/162542

PCT Pub. Date: Sep. 13, 2018

(65) Prior Publication Data

US 2021/0131451 A1 May 6, 2021

(30) Foreign Application Priority Data

Mar. 9, 2017 (DE) ..... 102017203877.2

(51) Int. Cl.
*F04F 5/54* (2006.01)
*F04F 5/46* (2006.01)
(Continued)

(52) U.S. Cl.
CPC ..... *F04F 5/461* (2013.01); *F04F 5/22* (2013.01); *F01M 13/022* (2013.01); *F01M 13/04* (2013.01);
(Continued)

(58) Field of Classification Search
CPC ..... F01M 13/022; F01M 13/04; F02M 25/06; F02M 25/0872; F04F 5/20; F04F 5/54;
(Continued)

(56) References Cited

U.S. PATENT DOCUMENTS 3,635,601 A * 1/1972 Larson ..... F04F 5/464 417/191
3,875,922 A * 4/1975 Kirmss, Jr. ..... F02M 25/028 123/198 A
(Continued)

FOREIGN PATENT DOCUMENTS

DE 4303319 A1 * 8/1994 ..... F04F 5/20
DE 102 41 302 A1 3/2004
(Continued)

OTHER PUBLICATIONS

International Search Report for International Application No. PCT/EP2018/055584 dated May 23, 2018.

*Primary Examiner* — George C Jin
*Assistant Examiner* — Teuta B Holbrook
(74) *Attorney, Agent, or Firm* — Nexsen Pruet, PLLC; Seth Hudson

(57) ABSTRACT

The invention relates to a single-stage or multistage suction jet pump comprising a propelling nozzle (5), one or more suction nozzles (2), a diffuser (7), and a volume flow limiting valve in or directly in front of the propelling nozzle. The volume flow limiting valve has a valve element (4) in the overpressure region (1) of the suction jet pump, said valve element having an opening (8) with a cross-sectional area which is smaller than the cross-sectional area of the propelling nozzle (5). The valve element spans at least one additional gap opening (9) which first releases the cross-section of the gap opening (9) when the pressure difference between the overpressure region (1) and the suction region (2) increases and which switches in the event of a defined
(Continued)

large pressure drop and the valve element (4) reduces or closes the cross-section of the gap opening (9) such that the volume flow flowing over the opening (8) is limited to a defined level even in the event of a further increasing pressure difference.

4 Claims, 2 Drawing Sheets

(51) Int. Cl.
*F04F 5/22* (2006.01)
*F01M 13/02* (2006.01)
*F01M 13/04* (2006.01)

(52) U.S. Cl.
CPC ..... *F01M 2013/026* (2013.01); *F04F 5/466* (2013.01)

(58) Field of Classification Search
CPC ..... F04F 1/02; F04F 1/18; F04F 1/10; F04F 5/22; F04F 5/46; B01D 53/0446; B01D 2311/14; F02D 19/00; F04D 19/04
See application file for complete search history.

(56) References Cited

U.S. PATENT DOCUMENTS 5,667,366 A * 9/1997 Reef ..... B60K 15/077 417/186
7,243,642 B2 * 7/2007 Nishikawa ..... F01M 13/0416 123/572
10,550,743 B2 * 2/2020 Coolens ..... F01M 13/0416
2009/0314230 A1 * 12/2009 Nagenkogl ..... F02F 1/40 123/41.44
2010/0043734 A1 * 2/2010 Holzmann ..... F01M 13/0405 123/41.86
2010/0319793 A1 * 12/2010 Smid ..... F02M 37/025 137/565.22
2014/0190346 A1 * 7/2014 Landi ..... F15B 15/02 91/418
2016/0032798 A1 * 2/2016 Herman ..... B01D 46/10 95/268
2016/0138442 A1 * 5/2016 An ..... F01M 13/021 123/559.1
2016/0356250 A1 * 12/2016 Fletcher ..... F02M 35/10163
2016/0369820 A1 * 12/2016 Neel ..... F04B 37/14
2017/0234178 A1 * 8/2017 Mosher ..... F01M 13/0011 123/574

FOREIGN PATENT DOCUMENTS

DE 10 2010 015 030 A1 4/2011
DE 20 2010 001 191 U1 5/2011
DE 10 2013 106 673 A1 1/2014
DE 10 2013 000 236 A1 7/2014
DE 10 2015 208 906 A1 11/2016
EP 3 020 935 A2 5/2016

* cited by examiner

SWITCHED SUCTION JET PUMP

FIELD OF THE INVENTION

The invention relates to a switched single-stage or multistage suction jet pump, comprising a jet nozzle, one or more suction nozzles, a diffuser, and a volume flow limiting valve.

BACKGROUND OF THE INVENTION

The suction performance of a usual suction jet pump is controlled through the pressure acting on the jet nozzle. In an internal combustion engine with turbo charging, this propellant pressure is branched off the boost pressure of the engine and depends on the respective engine load point. The higher the torque produced, the higher is the boost pressure. If a suction jet pump is employed to produce a negative pressure in the crankcase or for tank ventilation, a sufficient suction performance is required already for lower boost pressures. However, the suction performance of the suction jet pump usually need not increase in parallel with the increasing boost pressure. For this reason, it is reasonable that the suction jet pump is throttled from a defined boost pressure. This is supposed to prevent that an unnecessarily large amount of air for combustion is branched off from the internal combustion engine to reduce the performance.

EP 3 020 935 A2 relates to a vehicle with an internal combustion engine, which comprises a crankcase and a charging unit, with a crankcase ventilation device, which comprises an inertia-based oil separator device with at least one inertia-based oil separator, an oil return flow returning separated oil to the crankcase and a suction jet pump which is driven by compressed air from the charging unit and which generates negative pressure in order to drive blow-by gas. The essential point is that the suction jet pump is regulated and/or controlled by a control device. The pump is throttled or switched off in the range of low boost pressure. In the range of high pressure, it is switched on at maximum effect.

In EP 3 020 935 A2, it is argued that no air should be withdrawn under low boost pressures of the internal combustion engine, in order not to affect the response of the internal combustion engine in partial-load and idle operation and thus not to decrease the power. At higher pressures, branching off is no longer problematic, because sufficiently large amounts of compressed air are provided to the internal combustion engine, and there are no significant losses of engine power. In contrast, DE 10 2013 000236 A1 sets forth that a sufficient negative pressure is needed already for low boost pressures, which later on need not increase as fast as the boost pressure, however. This means that the suction jet pump must have a high suction performance already at low boost pressures; however, it may be reduced at higher boost pressures. For this reason, throttling of the jet stream of the suction jet pump is effected only at higher boost pressures here. In this case, the setting of the jet stream is effected in a self-regulating manner through the boost pressure.

The disadvantage of the known solutions resides in the fact that the maximum available pressure does not act at the first nozzle of the suction jet pump, because throttling is effected upstream from the nozzle. Part of the energy employed is always consumed already at the throttle valve and is to be considered mere loss energy. Further, the known systems have a very large construction.

BRIEF SUMMARY OF THE INVENTION

The object of the present invention is to integrate the throttle function directly into the jet nozzle of the suction jet pump.

Therefore, in a first embodiment, the present invention relates to a single-stage or multistage suction jet pump, comprising a jet nozzle 5, one or more suction nozzles in the intake zone 2, and a diffuser 7, characterized in that said suction jet pump has a device for reducing the nozzle cross-section and thus for limiting the jet stream in or directly upstream from the jet nozzle 5.

The intention is not thereby to throttle the pressure for operating the suction jet pump as in DE 10 2013 000236 A1, but to reduce the nozzle cross-section of the jet nozzle directly. This has the advantage that the complete boost pressure is still acting on the jet nozzle and can be used for generating the suction stream. Nevertheless, throttling of the propellant mass flow takes place. Further, the system can be constructed very compactly because of the direct integration.

BRIEF DESCRIPTION OF THE DRAWINGS

The present invention is illustrated and described herein with reference to the various drawings, in which like reference numbers denote like method steps and/or system components, respectively, and in which.

DESCRIPTION OF THE INVENTION

Figure 1:
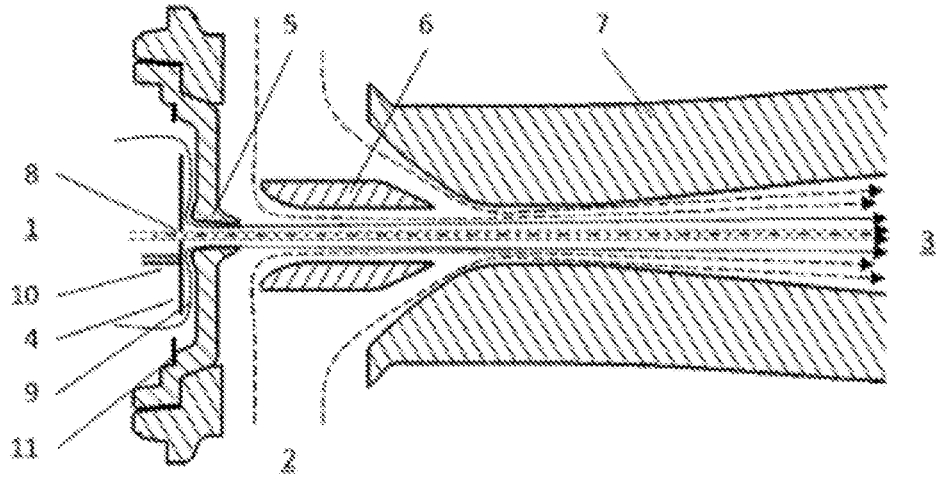
FIG. 1 shows the invention with a self-resilient valve body in a non-throttled switch position.
Figure 2:
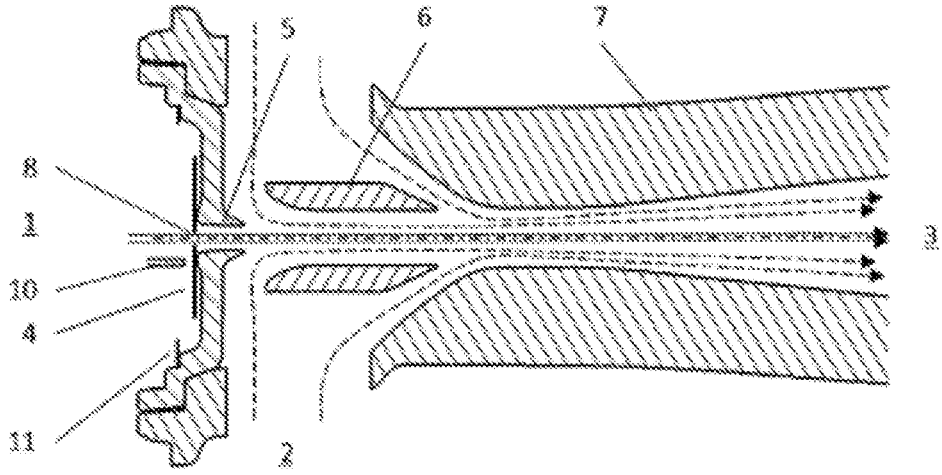
FIG. 2 shows the invention with a self-resilient valve body in a throttled switch position.

In particular, the invention consists of a single-stage or multistage suction jet pump as shown in FIGS. 1 and 2, comprising a jet nozzle 5, a diffuser 7, and optionally further nozzles 6. Upstream from the jet nozzle 5, there is the overpressure zone 1, which may be the boost pressure of a turbo engine, for example. The overpressure accelerates the jet fluid through the jet nozzle 5, so that the maximum speed is observed behind the nozzle. The dynamic pressure is thereby increased in this zone. For reasons of energy preservation, the static pressure drops. Air is thereby sucked from the suction zone 2 and then flows with the jet air through the diffuser 7, where the flow is decelerated. This can be utilized, for example, to produce a negative pressure in a crankcase or in a tank. The overall flow 3 can then be returned to the intake air of the internal combustion engine (for example, upstream from the compressor).

According to the invention, it is particularly preferred if the device for limiting the jet stream (volume flow limiting valve) in the overpressure zone 1 of the suction jet pump has a valve body 4, especially one comprising an opening 8 whose cross-sectional area is smaller than the cross-sectional area of the jet nozzle 5.

Because the limiting function is positioned upstream from or in the jet nozzle 5, almost the complete available boost pressure can be used to drive the suction jet pump. Further, the construction of the system is very compact. Also, the number of components is reduced.

The limitation of the jet stream according to the invention is preferably solved by a (resilient) valve body 4 that is mounted immediately upstream from the jet nozzle 5 of the suction jet pump.

The resilience is preferably realized by spring arms in the valve body 4. In this case, the valve body 4 rests, for example, on a support surface 11 in the body of the jet nozzle 5. Alternatively, however, a compression or tension spring may also be used. Further, the resilient element may be biased to set the switch point of the valve body 4. This can be realized, for example, by a downholder 10.

FIG. 1 shows that the valve body 4 in its original state has a distance to the jet nozzle 5, so that a gap 9 is formed between the valve body 4 and the body of the jet nozzle 5. The jet fluid flows through the valve body 4 in this state over the gap 9. Further, the fluid may flow through the opening in the valve body 4, if any. When the boost pressure increases, the jet stream increases, too (FIG. 2). Because of the jet stream and the Venturi effect, formation of the overall flow 3 takes place.

The present invention provides a mass flow control with a defined valve characteristic diagram and a small construction space. By means of the valve body 4, especially a spring sheet, the cross-section of the gap 9 through which the flow occurs is reduced between the overpressure zone 1 and the negative pressure zone, and thus the propellant mass flow is controlled.

Another advantage of the present invention resides in the fact that there is only one movable element, namely the valve body 4, especially a spring sheet.

The valve body 4 serves to control the cross-section through which the flow occurs, preferably in the form of a spring sheet. The spring sheet may be mounted, for example, in the overpressure zone 1 under a defined bias in order to give way for the gas flow through the gap 9. When the pressure drop increases because of a higher boost pressure, the valve body 4 will move towards the wall of the jet nozzle 5 up to the point in which the gap 9 is completely closed.

Depending on the jet stream, the valve body 4 produces a pressure loss. When this pressure loss exceeds the resilient force of the valve body 4, the latter will move towards the jet nozzle 5, slowly closing the gap 9. When the boost pressure increases, the jet stream is reduced. The same applies to the suction stream in the suction zone 2. At the end of the closing process, the valve body 4 creates an almost perfect seal on the body of the jet nozzle 5, so that the jet fluid can flow into the suction jet pump only through the opening in the jet nozzle 5, as shown in FIG. 2. The smaller opening in the valve body 4 limits the jet stream. However, because of the increase of the density of the fluid at higher boost pressures, another increase, albeit flat, of the jet stream occurs. The suction stream also increases further.

Preferably, the valve body 4 is to be designed in a way that the pressure loss is low, in order that the complete boost pressure can be utilized for driving the suction jet pump, if possible.

Figure 3:
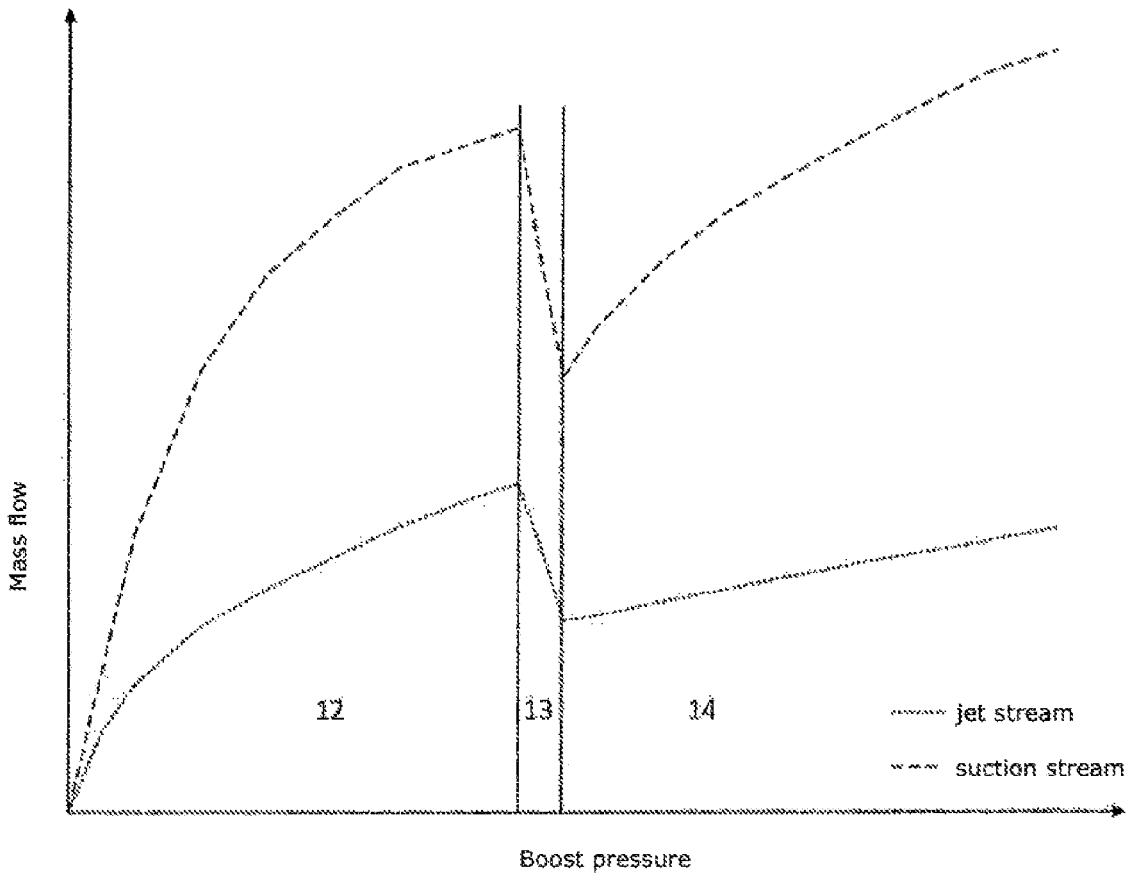
FIG. 3 shows a possible curve progression of the jet and suction stream as a function of the acting boost pressure.

FIG. 3 shows a possible curve progression of the jet and suction stream as a function of the acting boost pressure.

Another embodiment of the present invention relates to the use of the device defined above for the crankcase ventilation of an internal combustion engine in a housing between a crank chamber of a crankcase and an intake tract or tank ventilation.

Another embodiment of the present invention relates to the ventilation of an internal combustion engine in a housing between a crank chamber of a crankcase and an intake tract or tank ventilation by providing a suction jet pump, as defined above, in an internal combustion engine in a housing between a crank chamber of a crankcase and an intake tract or tank ventilation

LIST OF REFERENCE SYMBOLS

1 overpressure zone (for example, boost pressure)
2 intake zone (for example, crankcase or tank ventilation)
3 overall flow (for example, upstream from the compressor)
4 valve body
5 jet nozzle
6 second nozzle (optional)
7 diffuser
8 opening in valve body
9 gap below valve body
downholder/pretensioner
11 support for valve body (metal sheet variant)

The invention claimed is:

1. A single-stage or multistage suction jet pump, comprising a jet nozzle, one or more suction nozzles in an intake zone, and a diffuser, said suction jet pump has a valve body in or directly upstream from the jet nozzle in the overpressure zone of the suction jet pump, said valve body spanning at least one other gap, which when the pressure difference between the overpressure zone and the intake zone increases, at first opens the cross-section of the gap, but switches at a defined high pressure drop, and the valve body reduces the cross-section of or closes the gap in such a way that the volume flow through the opening is limited to a defined level even when the pressure difference increases further.

2. The suction jet pump according to claim 1, wherein said valve body comprises an opening whose cross-sectional area is smaller than the cross-sectional area of the jet nozzle.

3. The suction jet pump according to claim 1, characterized in that said valve body (4) is designed as a spring sheet attached under a bias by a downholder on the inlet of the suction jet pump.

4. A process for ventilating crankcases of an internal combustion engine providing a single-stage or multistage suction jet pump, comprising a jet nozzle, one or more suction nozzles in an intake zone, and a diffuser, said suction jet pump has a valve body in or directly upstream from the jet nozzle in the overpressure zone of the suction jet pump, said valve body spanning at least one other gap, which when the pressure difference between the overpressure zone and the intake zone increases, at first opens the cross-section of the gap, but switches at a defined high pressure drop, and the valve body reduces the cross-section of or closes the gap in such a way that the volume flow through the opening is limited to a defined level even when the pressure difference increases further; and inserting the suction jet pump in an internal combustion engine.

* * * * *